United States Patent [19]

Heyde

[11] Patent Number: 4,704,508

[45] Date of Patent: Nov. 3, 1987

[54] ELECTRIC ARC BREAKER

[75] Inventor: Hans H. Heyde, Santa Catarina, Brazil

[73] Assignee: Lorenzetti-Inebrasa S/A., Santa Catarina, Brazil

[21] Appl. No.: 888,790.

[22] Filed: Jul. 21, 1986

[30] Foreign Application Priority Data

Sep. 30, 1985 [BR] Brazil ..... 8504798

[51] Int. Cl.[4] ..... H01H 33/88

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 2,552,427 | 5/1951 | Heidmann | 200/148 A |
| 2,909,632 | 10/1959 | Pelenc | 200/148 A |
| 3,071,670 | 1/1963 | Yeckley et al. | 200/148 A |
| 3,381,101 | 4/1968 | Strom et al. | 200/148 A |

*Primary Examiner*—Robert S. Macon

*Attorney, Agent, or Firm*—Michael J. Striker

[57] ABSTRACT

An electric arc breaker is formed as a unit in a capsule filled with pressure gas and comprising a movable contact arranged in a support having a shoe against which a blower base is fastened. The blower has at the end opposite to its base a fixed diffuser turned towards a base of a fixed contact, which is provided with a damping spring.

4 Claims, 5 Drawing Figures

ELECTRIC ARC BREAKER

BACKGROUND OF THE INVENTION

This invention relates to an electric arc breaker.

The quenching of high voltage electric arcs is usually carried out with the use of instruments commonly known as loaded isolating switches and circuit breakers.

These devices use several techniques and different means for the quenching of electric arcs.

This invention refers in particular to an electrical monopolar, bipolar or tripolar device, fully capsuled in a metallic cover, to be either exposed to weather or in sheltered surroundings and which employs as arc quenching means gas under pressure, such as sulfur hexafluoride (SF6) or some other adequate gasses, and as technique, the pressure blowing of this gas directed straight towards the electric arc root.

There are many electrical devices which exist and are commercialized throughout the world, which also use gas as means and pressure blowing as technique, however, this invention uses a new and original system of pressure blowing mechanism.

The existing devices which use gas pressure blowing are usually constructed with a piston which is operated by the apparatus mechanism and directs the gas through a place so as to surround the electric arc from all sides.

SUMMARY OF THE INVENTION

The device of this invention uses a system of transverse blow to the electric arc, that is, instead of fully surrounding the electric arc with pressure blown gas, the arc will be quenched by means of a transversal blow coming from one single direction, caused by a blower activated by the mechanism of the device, so that the gas is directed under pressure to the electric arc area through an adequate place.

The shape of its construction is also new and differs from other devices by its original construction, as will be seen in the description which follows hereunder.

This device may be used in any position, standing, lying, upside down or inclined in any position, always continuing with its characteristics unaltered.

DETAILED DESCRIPTION OF THE PREFERRED EMBODIMENT

Figure 1:
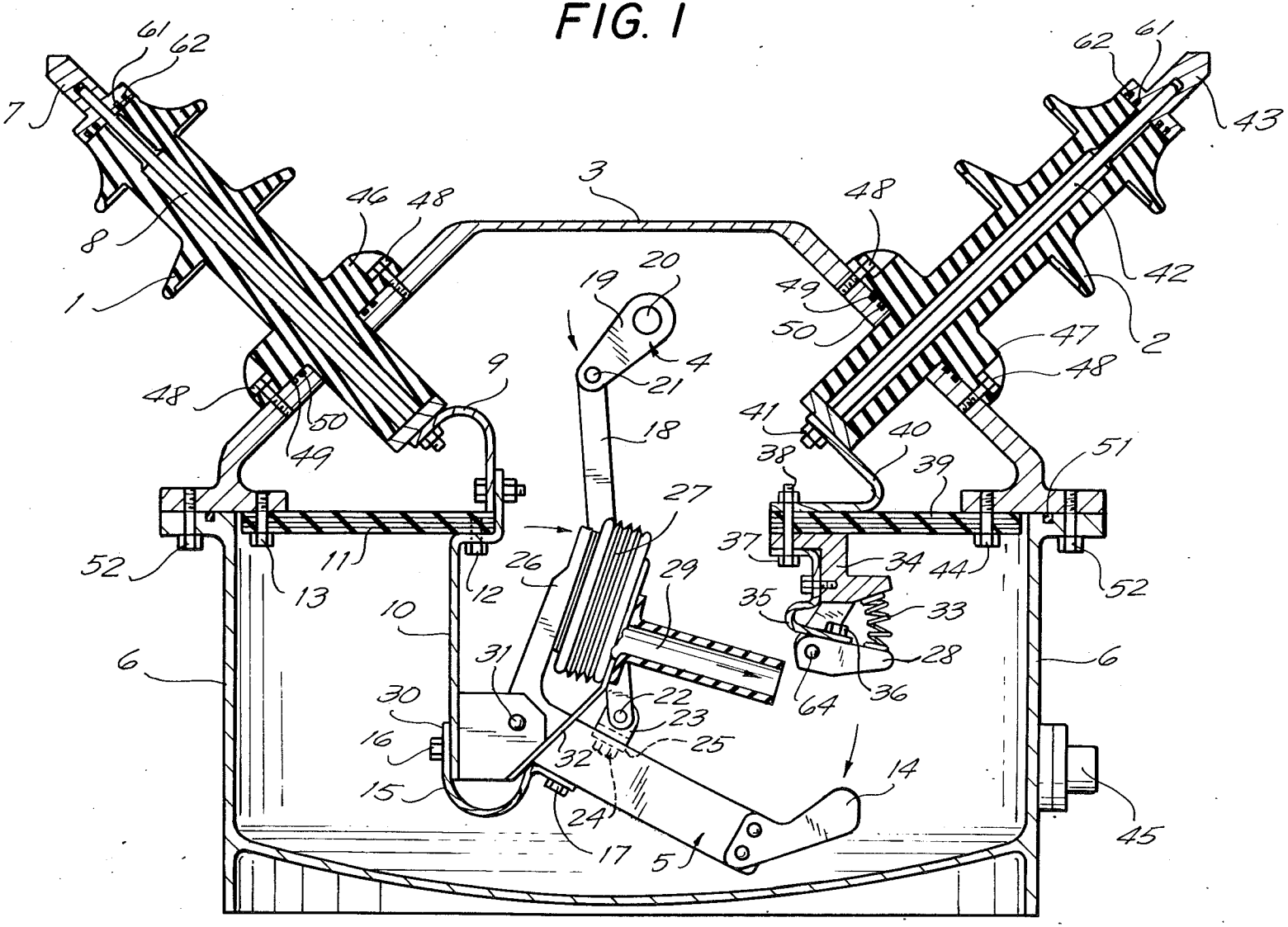
FIG. 1—shows a longitudinal section of the device, when it is in open contact position.
Figure 2:
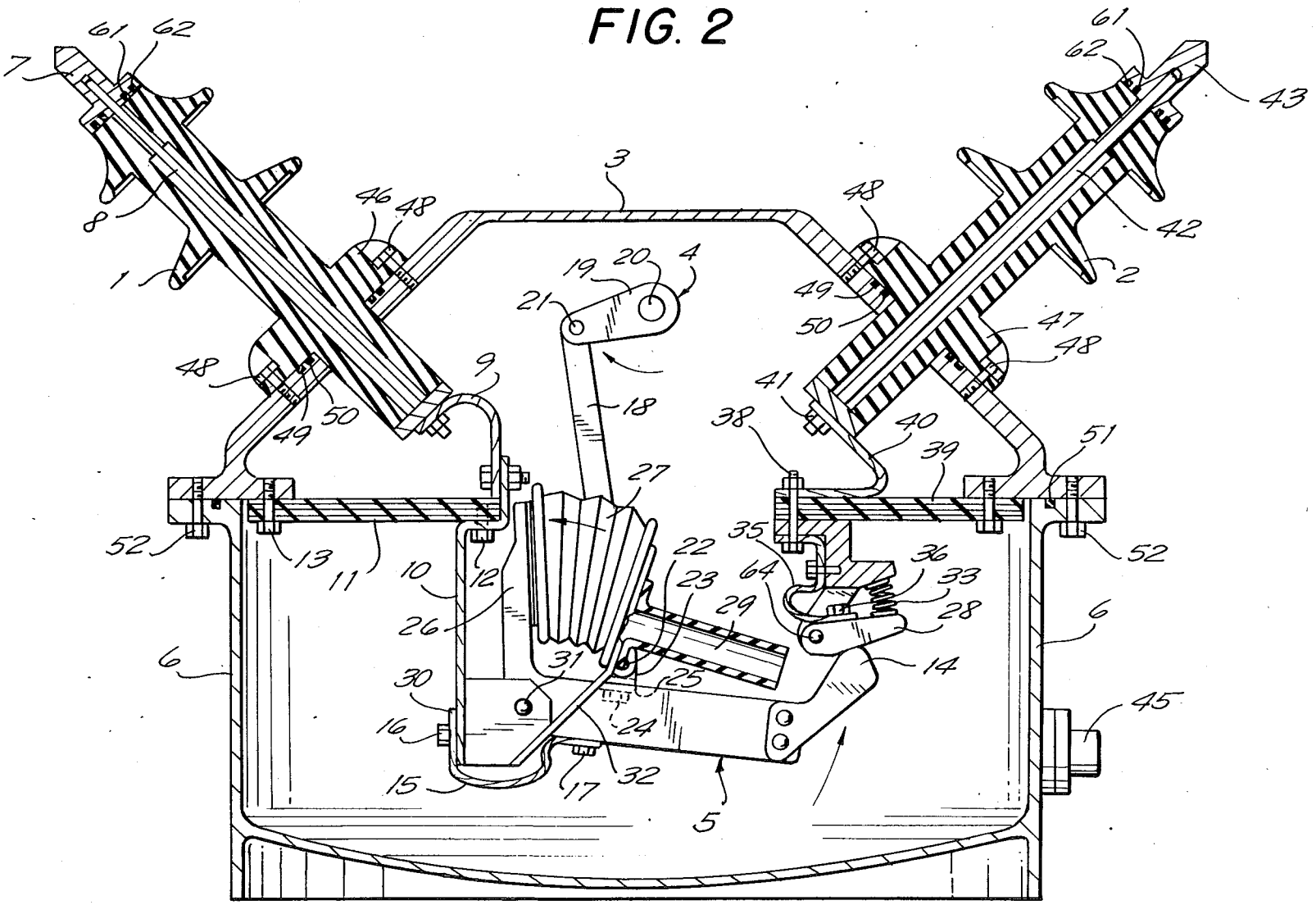
FIG. 2—shows the device in closed contact position.

According to the attached drawings and in all its details, the electric arc breaker according to the invention consists of six main parts, which are:—input 1 and output 2 insulators, the insulators' support 3, the driving unit 4, breaking mechanism 5 and cover 6.

The electric current comes from the outside line through electric cables (not shown in the figures), connected to metallic terminals 7 (FIG. 1).

It thereafter passes through the metallic connector 8 and through the flexible cordage 9, reaching a breaking system 5 through metallic support 10.

This support 10 is electrically insulated from support 3 and from cover 6, as it is screwed to a base 11, manufactured of insulated material, by screws 12. The base 11 is rigidly connected to the support 3 by the screw 13, as may be seen in FIG. 1.

The electric current passes then from the support 10 to the moving contact 14 through a metallic cordage 15 which is connected to the support 10 by screw 16 and to the moving contact 5 by a screw 17.

The end of the moving contact 14 is fixed to the moving contact unit 5 by means of a weld or rivet.

The moving contact 5 is moved by a rod 18 which is connected to a driving element 19 which is part of the driving unit 4.

Figure 3:
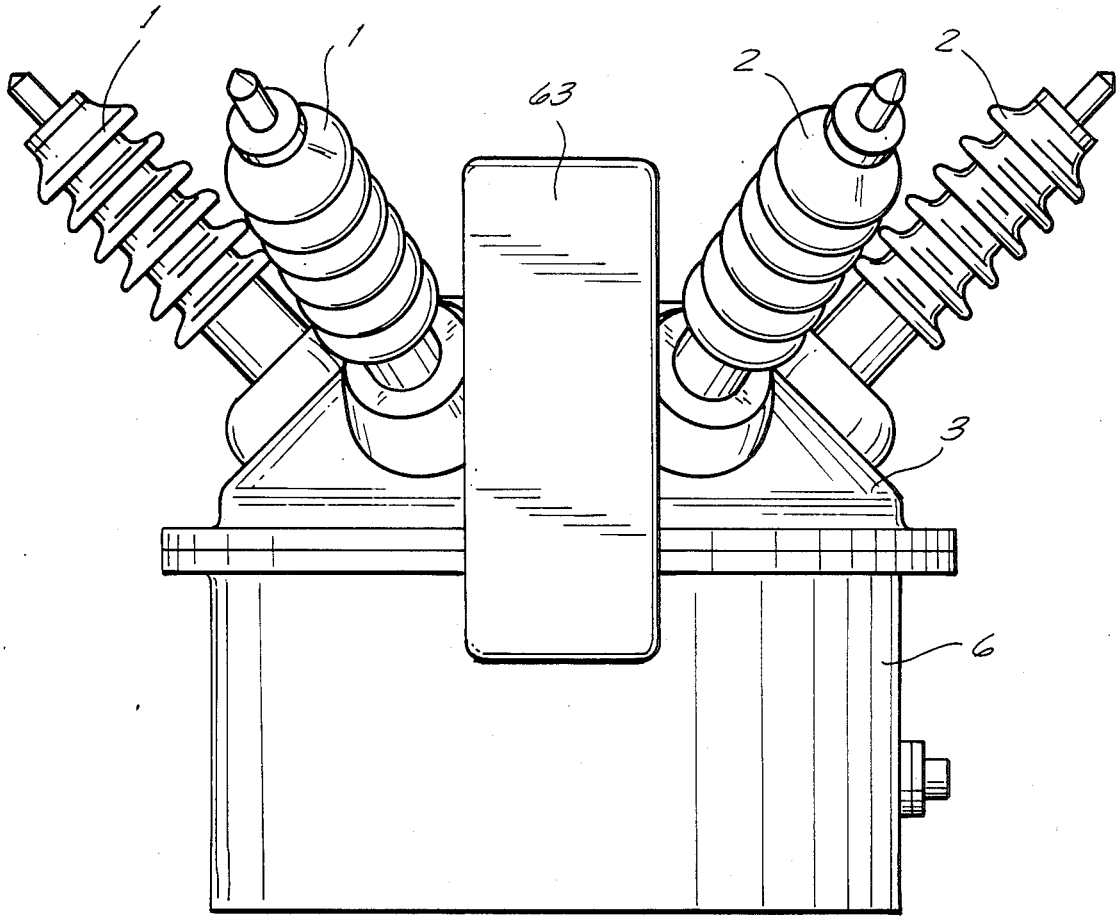
FIG. 3—shows a tripolar structure of the device, seen from outside in the same position as in FIGS. 1 and 2.
Figure 4:
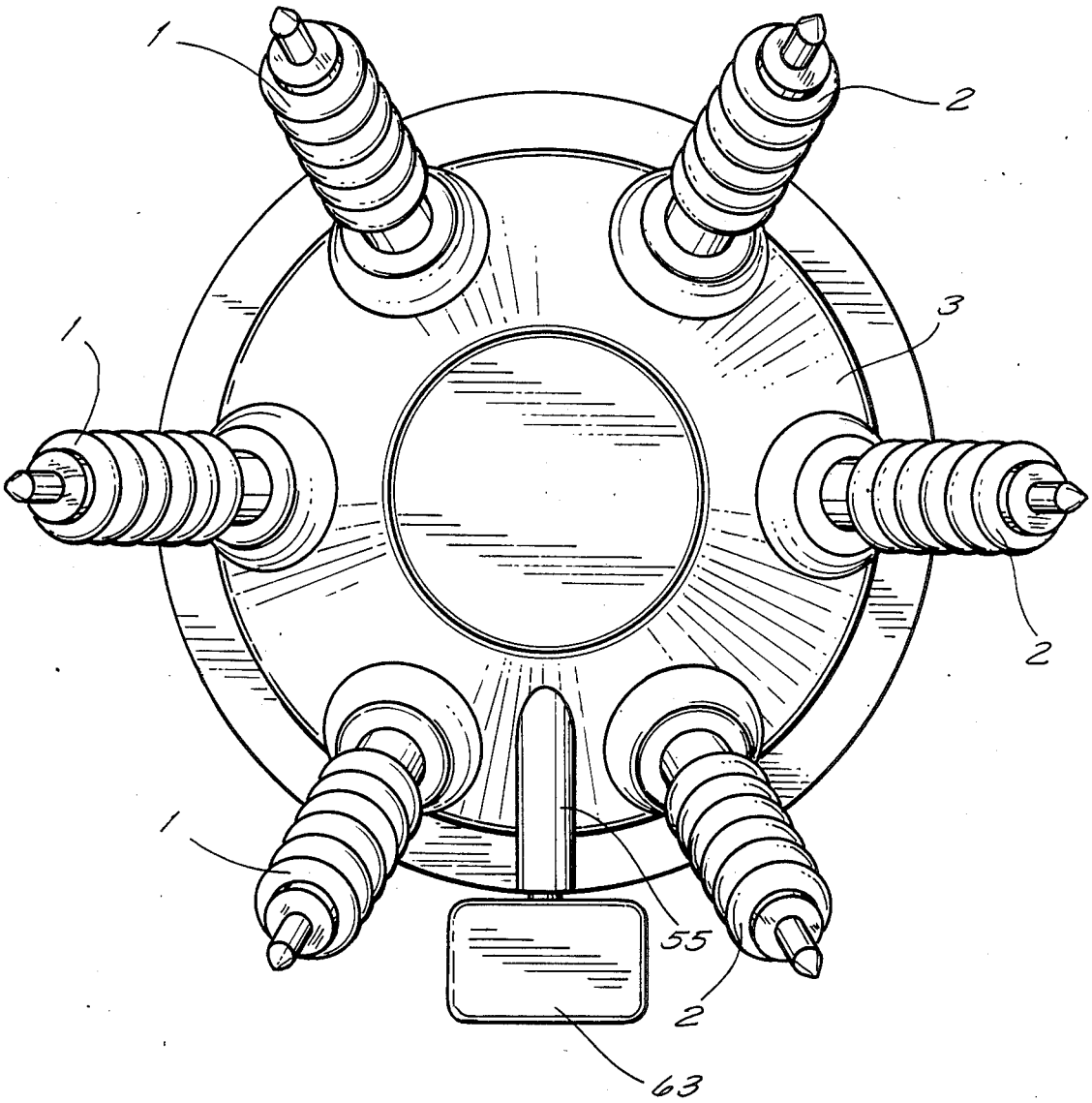
FIG. 4—shows the tripolar structure of the device seen from above on the left side of insulators.

When a mechanical control 63 on the outside of the device, and which is schematically shown in FIGS. 3 and 4, revolves driving axle 20, the latter moves simultaneously the rod 18 through the driving element 19, as may be seen from FIG. 1.

This driving element 19 transfers the rotating movement of the axle 20 to a longitudinal travel of the rod 18, which is linked at its upper part to an upper axle 21 of the rod 18. Rod 18 is also linked at a lower axle 22, so that the rotating movement of the driving element 19 is transformed into a longitudinal travel of the rod 18, which causes the opening or closing of the moving contact 5. The connection between the rod 18 and the several moving contacts 5—in case of two contacts (two-pole) or three contacts (three-pole)—is made by means of a crosspiece 23 which connects the different moving contacts 5 through screws 24 which in turn connect the lug 25 of moving contact 5 to the crosspiece 23.

When moving in the direction to close the moving contact 5, the other end 26 of the moving contact 5 activates a blower 27 which causes a powerful expulsion of the gas contained inside the blower 27. The gas is directed towards the root of a electric arc on the fixed contact 28, through a diffuser 29 which is glued onto the blower 27. This diffuser 29 is rigidly connected to a bearing 30 of the moving contact 5.

This bearing 30 is an integral part of the metallic support 10. In this manner when the driving axle 20 moves, a rotating movement is caused on the moving contact 5 around its axle 31.

This rotation will press the blower 27 against the diffuser 29, which remains permanently immovable since it is rigidly connected through a support 32, which is an integral part of the metallic support 10.

The gas ejected in this manner on the electric arc which is formed between the fixed contact 28 and the end 14 of the moving contact 5 causes cooling down of the arc and, consequently, its quenching at the current zero passage.

In order that this cooling reaches its maximum efficiency, the gas under pressure inside the blower 27 is directed on the arc by the diffuser 29, correctly placed.

This diffuser 29 is manufactured of insulating material, having adequate properties to resist heat generated by the electric arc.

The fixed contact 28 has actually a small movement around its axle 64.

This movement consists of a small rotation on an axle 64. A spring 33 promotes the circular movement of the fixed contact 28.

The purpose of this mechanism is to obtain that the fixed contact 28 remains pressed against the end 14 of the moving contact 5 when the device has its contacts closed, thus providing conditions for the passage of the electrical current.

On the other hand, the existence of the spring 33 provides damping against the closing impact of contacts, as, when the end 14 of the moving contact 5 is violently ejected onto the fixed contact 28, it will press with this movement the spring 33 which will in this manner absorb this mechanical shock.

Besides, this relative movement which takes place between the surfaces of the fixed contacts 28 and the end 14 of the moving contacts 5, provides a cleaning of these contacts surface every time same are operated, which increases its electrical life.

The fixed contact 28 is electrically connected to the support of the fixed contact 34 by means of a flexible cordage 35, which is at one side screwed to the fixed contact 28 by screw 36 and at its other end, it is connected to the fixed contact 34 supported by screw 37, as may be seen in FIG. 1.

The fixed contact 34 is rigidly connected to an insulating support plate 39 by means of metallic screw 38.

The metallic screw 38, besides keeping physically together the support of the fixed contact 34 with the insulating support plate 39, is also responsible for the conduction of power through its connection with a flexible cordage 40.

The flexible cordage 40 is connected to a metallic connector 42 of the output insulator 2.

In its turn, the metallic connector 42 which is placed inside the output insulator 2, is electrically connected to the support of the fixed contact 34 through a nut 41 which keeps firm the other end of the flexible cordage 40.

The upper end of the metallic connector 42 is screwed to a metallic terminal 43 which is connected to the electric line by means of cables and connections which are not shown in this figure.

The insulating support 39 is rigidly screwed to the support 3 by means of the screw 44.

A valve 45 makes possible the creation of vacuum inside the device and the subsequent filling of gas.

The flanges 46 of the insulator 1 and 47 of the insulator 2 are cemented to their respective insulators and screwed to the support 3 by means of screws 48, uniformly distributed around these flanges, as may be seen in FIG. 1.

The gas cannot leak through the insulators passage holes due to the existence of sealing rings 49 and 50, manufactured in rubber or another adequate elastomere.

A retainer ring 51 seals the gas outlet between the support 3 and the cover 6.

The cover 6 and the support 3 are screwed one to another by means of screws 52.

Also the gas leakage at the insulators upper end of the input 1 and outlet 2 has been checked, due to the existence of retainer rings 61 and 62, which are pressed between metallic terminals 7 and 43 and the rectified upper faces of the input 1 and outlet 2 insulators.

Figure 5:
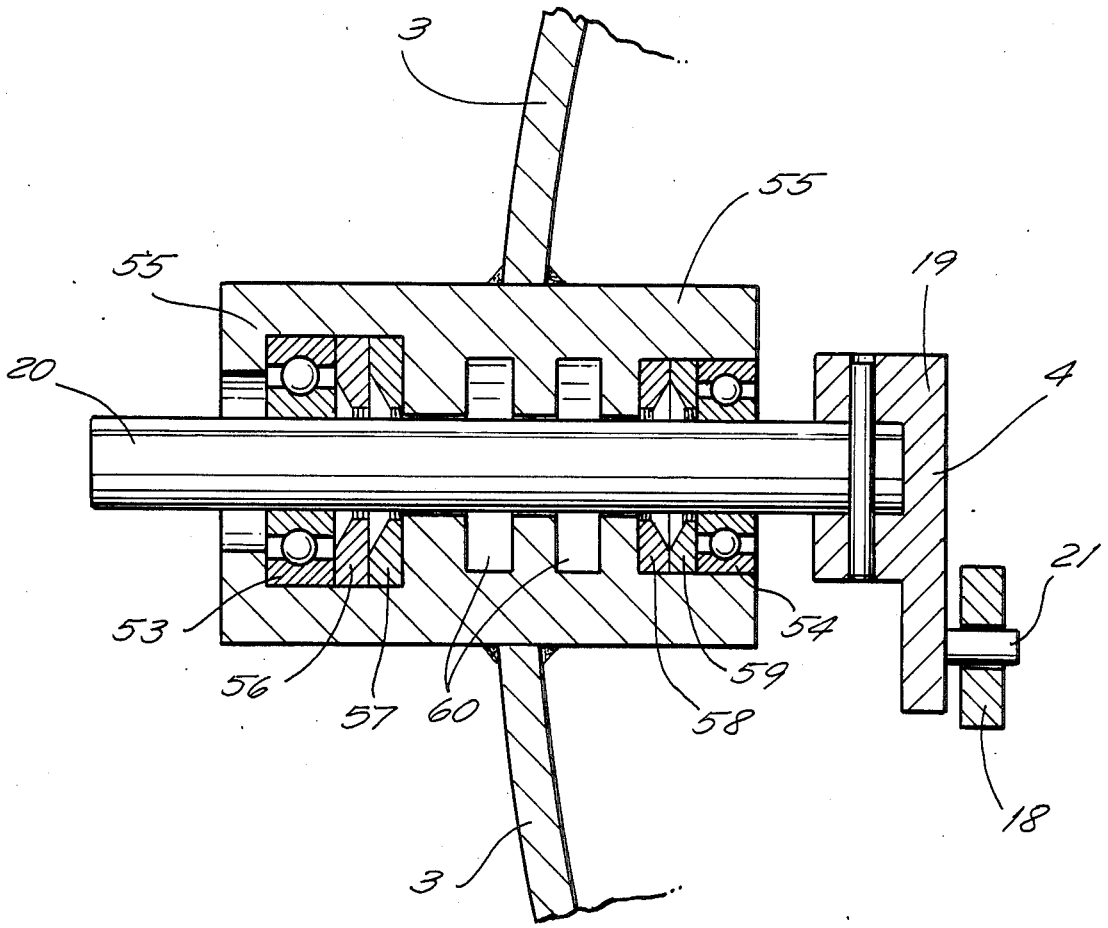
FIG. 5—shows the detail of the driving axle of device contacts.

FIG. 5 shows a section along the axle of the driving element 20. This FIG. 5 shows how the gas kept inside the device under pressure is hindered from escaping through the axle of the driving element 20.

The sealing is of the liquid type. The axle of the driving element 20 rotates in roller bearings 53 and 54 which rest on bearing 55. This bearing 55 is constructed of the same metal as the support 3 and may be a component part of this support 3, cast in one single part, as well as it is possible to machine it and then weld it to the support 3.

Retainers 56, 57, 58 and 59 assure that the oil contained in chamber 60 does not leak outside.

When the gas contained inside the device tries to escape, it forces the actuation of retainers 58 and 59 and in case it passes through these two retainers, it will force the oil contained in the chamber 60 against retainers 57 and 56, which will, in their turn, guarantee perfect tightness against oil leakage. In this manner it is obtained that a gas leakage is checked by means of retainers for oil.

The quick and abrupt opening of the moving contacts 5 is made through a mechanical device 63, adequate for this operation and which is not part of this application.

This mechanical device 63 is shown in FIGS. 3 and 4 in a schematic form and is located outside the apparatus. This device can be mechanical-electrical, hydraulic, moved by springs, by compressed air, operated manually or by an engine.

It will be understood that each of the elements described above, or two or more together, may also find a useful application in other types of electric arc breakers differing from the types described above.

While the invention has been illustrated and described as embodied in an electric arc breaker, it is not intended to be limited to the details shown, since various modification and structural changes may be made without departing in any way from the spirit of the present invention.

Without further analysis, the foregoing will so full reveal the gist of the present invention that others can, by applying current knowledge, readily adapt it for various applications without omitting features that, from the standpoint of prior art, fairly constitute essential characeristics of the generic or specific aspects of this invention.

What is claimed as new and desired to be protected by Letters Patent is set forth in the appended claims:

1. An electric arc breaker formed as an enclosed unit and comprising a support and a cover connected to each other so as to form a leakproof container; a plurality of input and output insulators of said unit and fixed to said support and partially extending into said container; each input insulator having an insulator base and a connector (8), a plurality of flexible cordages (9) positioned inside said container and each connected to the connector of a respective input insulator; support means (10) fixed to said insulator base (11) and carrying bearing means (30) supporting an axle (31); and an arc breaking mechanism (5) pivotally supported on said axle and including an L-shaped plate having at one end a moving contact (14); a fixed contact (28), said moving contact facing said fixed contact; said arc-breaking mechanism further including a blower supported at the other end of said plate and supporting at a top thereof a diffuser (29) which is fixed to said bearing means; said cordages, support means, bearing means, and arc breaking mechanism being accommodated in said leakproof container.

2. The arc breaker as defined in claim 1, wherein said diffuser is combined with said blower into a unit, said diffuser having an opening directed towards said fixed contact.

3. The arc breaker as defined in claim 1, wherein said fixed contact is supported at one end thereof by an axle (64) and is damped at another end thereof by a damping spring (33).

4. The arc breaker as defined in claim 1, further including driving means for said arc breaking mechanism, said driving means including an externally actuated control axle (20), an arm (19) connected to said axle, and a rod (18) interconnected between said arm and said L-shaped plate.

* * * * *